US005365246A

United States Patent [19]

Rasinger et al.

[11] Patent Number: 5,365,246

[45] Date of Patent: * Nov. 15, 1994

[54] TRANSMITTING AND/OR RECEIVING ARRANGEMENT FOR PORTABLE APPLIANCES

[75] Inventors: Josef Rasinger, Mödling; Arpad-Luwdig Scholtz; Ernst Bonek, both of Vienna, all of Austria

[73] Assignee: Siemens Aktiengesellschaft, Munich, Germany

[ * ] Notice: The portion of the term of this patent subsequent to Aug. 15, 2009 has been disclaimed.

[21] Appl. No.: 828,792

[22] PCT Filed: Jul. 26, 1990

[86] PCT No.: PCT/EP90/01227

§ 371 Date: Apr. 27, 1992

§ 102(e) Date: Apr. 27, 1992

[87] PCT Pub. No.: WO91/02386

PCT Pub. Date: Feb. 21, 1991

[30] Foreign Application Priority Data

Jul. 27, 1989 [AT] Austria ..... A 1815/89

[51] Int. Cl.[5] ..... H01Q 1/24; H01Q 9/04

[52] U.S. Cl. ..... 343/702; 343/833; 343/830

[58] Field of Search ..... 343/702, 833, 834, 837, 343/845, 846, 742, 829, 830, 745, 748; H01Q 1/24, 9/04

[56] References Cited

U.S. PATENT DOCUMENTS

| | | | |
|---|---|---|---|
| 4,516,127 | 5/1985 | Siwiak | 343/702 |
| 4,584,585 | 4/1986 | Marko et al. | 343/702 |
| 4,625,212 | 11/1986 | Oda et al. | 343/702 |
| 4,641,366 | 2/1987 | Yokoyama et al. | 343/702 |
| 4,800,392 | 1/1989 | Garay et al. | 343/702 |
| 4,849,765 | 7/1989 | Marko | 343/702 |
| 4,876,552 | 10/1989 | Zakman | 343/702 |
| 5,144,324 | 9/1992 | Chin et al. | 343/702 |

FOREIGN PATENT DOCUMENTS

| | | |
|---|---|---|
| 387117 | 4/1988 | Austria . |
| 0177362 | 10/1985 | European Pat. Off. . |
| 2067842 | 7/1981 | United Kingdom . |
| WO84/04427 | 11/1984 | WIPO . |

OTHER PUBLICATIONS

"Performance Analysis of a Built-In Planar Inverted F Antenn for 800 MHz Band Portable Radio Units", by T. Taga et al., IEEE Journal on Selected Areas In Communications, vol. SAC-5, No. 5, Jun. 1987, pp. 921-929.

"Diversity Antennas For Portable Telephones", by K. Tsunekawa NTT Radio Communication Systems Laboratories, Japan (1989), no month pp. 50-56.

*Primary Examiner*—Donald Hajec
*Assistant Examiner*—Hoanganh Le
*Attorney, Agent, or Firm*—Hill, Steadman & Simpson

[57] ABSTRACT

An antenna for transmitter and receiver of a portable radio appliance (cordless telephone, mobile telephone, pager, telepoint appliance and so forth) essentially consists of two sheet-metal angles (2,3) which are arranged adjacently to one another. One of the two elements is excited with radio-frequency currents by means of a coaxial feedline (4). The second sheet-metal angle (3) is excited by parasitic coupling from the first sheet-metal angle (2). The sheet-metal angles (2,3) are identically oriented and the distance between them is much shorter in the end area than at the bending edge of the apex line. This results in high reactive currents and low impedance. The antenna can also be modified by feeding both sheet-metal angles (2,3), dividing it into two identical part-antennas or several sheet-metal angles. The sheet-metal angles can consist of metal foils which are applied to a plastic housing. In addition, an embodiment with wire angles is also possible.

24 Claims, 3 Drawing Sheets

TRANSMITTING AND/OR RECEIVING ARRANGEMENT FOR PORTABLE APPLIANCES

BACKGROUND OF THE INVENTION

The invention relates to a transmitting and/or receiving arrangement for portable appliances, consisting of a shielding housing of metal, containing the radio-frequency section, and an antenna, the antenna consisting of two or more antenna resonators which are parasitically coupled to one another and are essentially identically oriented in the longitudinal direction, having in each case one free resonator end and in each case one end angled via a bending edge and conductively connected to the shielding housing.

In EP-A 177 362, a wide-band antenna for portable radio appliances is described. It consists of two angled resonators of different resonant frequency. The two resonators are fed by a common line via a branch of the type of an "inverted-F antenna". The antenna resonators act independently of one another and do not form a unit. This is why the efficiency is not particularly high. The distance between the parallel legs is constant.

In U.S. Pat. No. 4,584,585, an antenna with resonators of wire angles is described. One resonator is fed at the end and forms an "inverted-L antenna". The second resonator is parasitically coupled. Although this arrangement achieves a good efficiency, the antenna has a fixed impedance and cannot be easily matched. The shape of the active antenna resonator is relatively difficult to bend and, in addition, the baseplate also exhibits a step. The bandwidth is relatively narrow.

In GB-A 2 067 842, a microstrip antenna is described which is applied to an insulating ground. Here, too, the distance between the two antenna resonators is constant. The free ends of the resonators are opposite one another. The feedpoint is close to the free end of one resonator.

"Inverted-F antennas" are known from T. Taga and K. Tsunekawa, "Performance Analysis of a Built-in Planar Inverted F Antenna for 800 MHz Band Portable Radio Units," IEEE Trans., Selected Areas in Commun., vol. SAC-5, no.5, pp. 921–929, June (1987). Such antennas are matched by varying the position of the feedpoint.

SUMMARY OF THE INVENTION

The invention is based on the object of improving the transmitting and receiving power of the antenna whilst ensuring that it is simple to produce and easily matched and has a wide bandwidth.

The object of the present invention is achieved by a transmitting and/or receiving arrangement for portable appliances, consisting of a shielding housing of metal, containing the radio-frequency section, and an antenna, the antenna consisting of two or more antenna resonators which are parasitically coupled to one another and are essentially identically oriented in the longitudinal direction, having in each case one free resonator end and in each case one end angled via a bending edge and conductively connected to the shielding housing, the transmitter output and receiver input, respectively, being connected only to the feedpoint of a single antenna resonator, if necessary via a duplex filter, via a feedline through a coaxial feedthrough in the shielding housing, which feedpoint is located between the bending edge and the free resonator end of this single antenna resonator, and the clearance of the slot formed between two adjacent antenna resonators being much less in the area of the free resonator end than at the bending edge for varying the input impedance of the antenna.

The resonators of the antenna which are not fed are parasitically excited by the fed resonator as a result of which the bandwidth of the antenna is increased. Due to the angled shape and the widening of the ends, currents flow in all three spatial directions. High reactive currents form which require low impedance. This fills gaps in the directional pattern of the antenna. Due to the low requirement for space, the arrangement is very well suited for mobile radio applications. It can be easily manufactured and the entire radio-frequency, audio-frequency and digital electronics of a portable radio appliance can be accommodated in the shielding housing. At the same time, the metal housing is used as the equivalent ground for the antenna. The range of variation becomes particularly great by changing the point of attachment of the feedline at the antenna resonator and by the fact that the resonators are widened in the area of their ends for varying the input impedance of the antenna. As a result, matching networks between antenna and transmitting output stage and transmitting filter and between antenna and receiver input and receiving filter can be omitted in many applications. The arrangement of the antenna resonators which are essentially parallel to one another can also be described as slot antenna, the input impedance being variable within wide limits by means of the width and shape of the slot between the resonators.

The the object can also be achieved by a transmitting and receiving arrangement for portable appliances, consisting of a shielding housing of metal, containing the radio-frequency section and an antenna, the antenna consisting of two or more antenna resonators which are parasitically coupled to one another and are essentially identically oriented in the longitudinal direction, having in each case one free resonator end and in each case one end angled via a bending edge and conductively connected to the shielding housing, the transmitter output and the receiver input in each case being connected via a transmitting filter and receiving filter, respectively, to the feedpoint of another antenna resonator via one feedline each through a coaxial feedthrough in the shielding housing, which feedpoint is in each case located between the bending edge and the free resonator end of the respective antenna resonator, and the clearance of the slot formed between two adjacent antenna resonators being much less in the area of the free resonator end than at the bending edge for varying the input impedance of the antenna.

In addition to the advantages of the arrangement set forth above, the feeding of two antenna resonators and the connection of the feedlines to transmitting and receiving filters result in a partial decoupling of transmitter output and receiver input. In addition, transmitter and receiver matching can be separately optimized.

In principle, the antenna can be located above any side area of the shielding housing. However, tests have shown that it is advantageous if the antenna resonators are arranged on the top or cover area of the shielding housing. For diversity operation, the antenna is built up of at least two fed part-antennas which are opposite one another and which in each case consist of the two or more antenna resonators which are parasitically coupled to one another and are essentially identically oriented (FIG. 4). Both part-antennas can be of equal length, producing double resonance. The antenna consists of $\lambda/4$ resonators. The bandwidth can therefore be increased even further if the antenna resonators have unequal lengths.

A reliable mechanical structure is achieved by the angled antenna resonators being formed from sheet-metal angles. To improve the radiation pattern, it is advantageous that there are three sheet-metal angles and the center sheet-metal angle is connected to the feedline. To produce the metal parts in a single work cycle, it is advantageous for the shielding housing and the sheet-metal angles to be stamped out of a flat metal sheet and to be bent into the appropriate shape. However, it is also possible for the sheet-metal angles to be soldered to the shielding housing.

The mechanical load-carrying capability of the antenna is increased by the sheet-metal angles having a U-shaped longitudinal section and the leg which is not fed or not parasitically coupled being conductively attached to a board protruding from the shielding housing and connected to the shielding housing via a ground area. Particular rigidity is achieved by the fact that the board protrudes between the free resonator ends of the sheet-metal angles and the resonator ends are connected to the board. Due to these measures, the antenna can be integrated on the board.

A particular mechanical robustness is given by the fact that the shielding housing is surrounded by a plastic housing onto which the sheet-metal angles are applied as metal foil on the outside or inside and are connected to the shielding housing via a ground feed-through.

In addition, it is also advantageous that the angled antenna resonators are formed from wire angles. These wire angles extend towards one another in such a manner that their free resonator ends are only barely separated from one another. Here, too, high currents flow and a low impedance is obtained. Compared in the "inverted-L structure", the "inverted-F structure" has the advantage of a higher quality factor of the matching to the wideband characteristic. The improvement is about 50–100%.

BRIEF DESCRIPTION OF THE DRAWINGS

The features of the present invention which are believed to be novel, are set forth with particularity in the appended claims. The invention, together with further objects and advantages, may best be understood by reference to the following description taken in conjection with the accompanying drawings, in the several Figures in which like reference numbers identify like elements, and in which:

DESCRIPTION OF THE PREFERRED EMBODIMENT

In the illustrative embodiments following, antennas having two or more angled resonators are described which can be incorporated in portable radio appliances such as cordless telephones, mobile telephones, pagers, "telepoint appliances" and so forth. As an internal antenna for a digital cordless telephone, the antenna is set to the 1.7-GHz band. The common functional features are generally specified only in the first illustrative embodiment.

Figure 1:
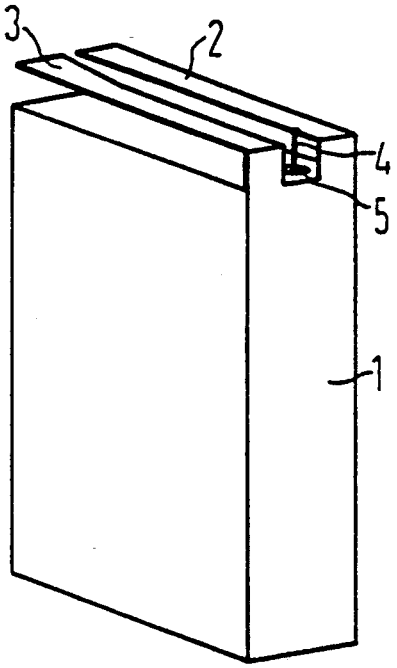
FIG. 1 shows an example with two sheet-metal angles.

The structure of a first antenna is shown in FIG. 1. On a shielding housing 1, the two sheet-metal angles 2, 3 acting as antenna are attached to the top. The shielding housing 1 contains all of the radio-frequency, audio-frequency and digital electronics of the mobile section of a cordless telephone.

Apart from the shielding, the shielding housing 1 also fulfills the function of an equivalent ground for the antenna and influences the bandwidth. The larger it is, the narrower the bandwidth will be. The top of the shielding housing 1 has been found to be an advantageous place for attaching the antenna.

The shielding housing 1 (or parts of it) and the sheet-metal angles 2, 3 are stamped out of a flat metal sheet and bent appropriately as shown in FIG. 1. To the first sheet-metal angle 2 a feedline 4 is connected which leads out of the interior of the shielding housing 1 via a coaxial feedthrough 5. The first sheet-metal angle 2 is thus is the fed element of the antenna and the second sheet-metal angle 3 is parasitically coupled to the first sheet-metal angle 2. The feedline 4 is connected to a receiver input and receiver output, respectively, via a duplex filter in the interior of the shielding housing 1.

Figure 2:
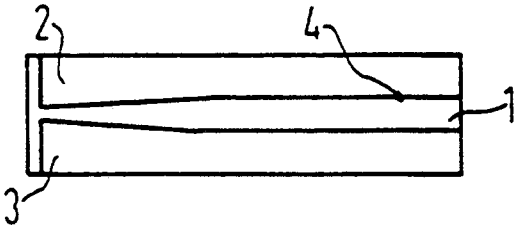
FIG. 2 shows the plan view with the antenna area.

FIG. 2 shows the point of attachment of the feedline 4 to the first sheet-metal angle 2. The location of this point of attachment and the shaping of the edges, facing one another, of the sheet-metal angles 2, 3 allow the input impedance of the antenna to be varied over a wide range. The sheet-metal angles 2, 3 are widened towards the ends. This saves a matching network between the antenna and the transmitter output or receiver input, respectively. The two sheet-metal angles 2, 3 have different lengths. Due to the resultant different resonant frequencies of the individual radiators, the bandwidth is considerably increased compared with a comparable antenna consisting of only a single sheet-metal angle.

Figure 3:
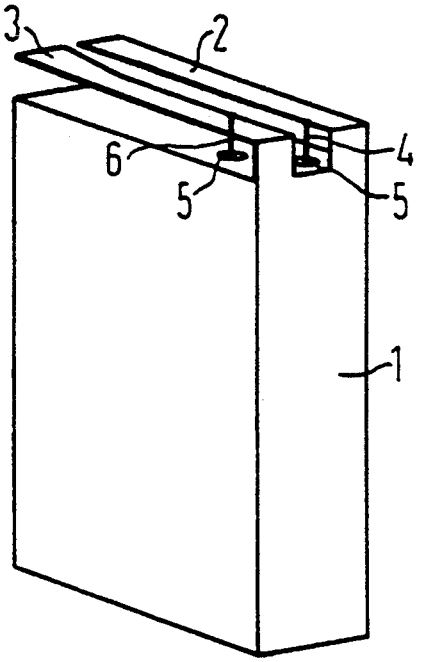
FIG. 3 shows an example with two feedlines.

FIG. 3 shows an alternative possibility of connecting transmitter and receiver to the antenna according to the invention. The first sheet-metal angle 2 is connected to the first feedline 4 and the second sheet-metal angle 3 is connected to a second feedline 6. The feedlines 4, 6 are brought out via feedthroughs 5. The transmitter output is connected to the first sheet-metal angle 2 via a transmitting filter. The receiver input is correspondingly connected to the second sheet-metal angle 3 via a receiving filter. This type of construction produces some of the required decoupling between transmitter output and receiver input. The variation of the input impedance by shaping the sheet-metal angles 2, 3 and the variation of the point of attachment of the feedlines 4, 6 are as in the first illustrative embodiment.

Figure 4:
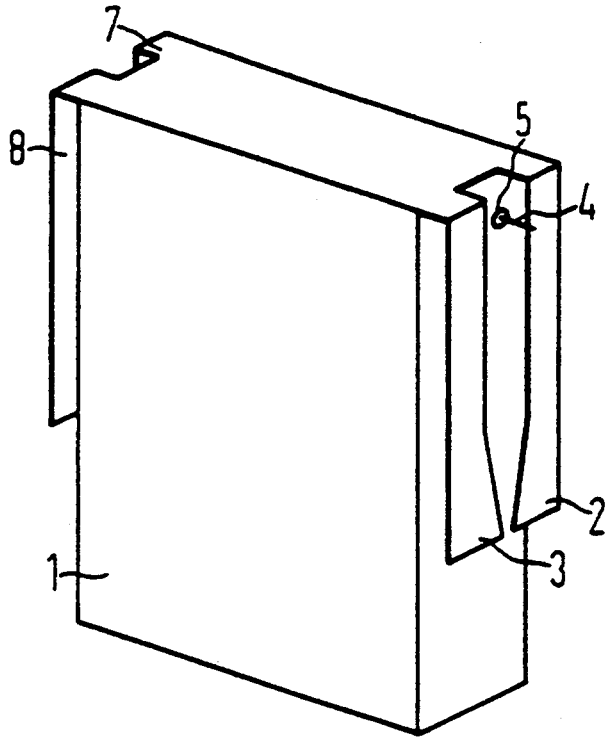
FIG. 4 shows an example with two part-antennas.

FIG. 4 shows an antenna arrangement for diversity operation. Two part-antennas are placed in front of the shielding housing 1 on its narrow side. The first part-antenna consists of the first two sheet-metal angles 2, 3. The second part-antenna is of identical construction and consists of sheet-metal angles 7, 8. The first part-antenna is fed via the feedline 4 through a coaxial feedthrough 5 and this correspondingly applies to the second part-antenna. The length of the resonators is $\lambda/4$. Both part-antennas are of equal length, resulting in double resonance.

Figure 5:
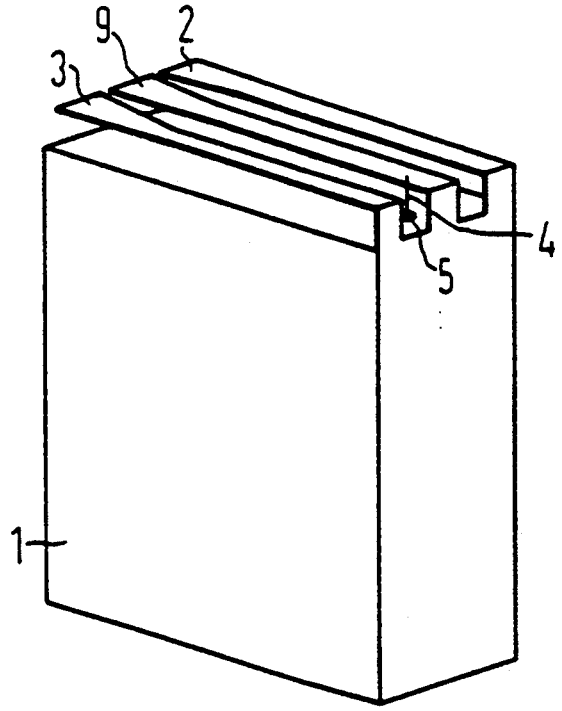
FIG. 5 shows an example with three antenna resonators.

In the transmitting and receiving arrangement shown in FIG. 5, a third sheet-metal angle 9 is arranged between the two sheet-metal angles 2, 3, seen from the shielding housing 1. The free resonator end of the third sheet-metal angle 9 is widened symmetrically towards the first two sheet-metal angles 2, 3. The feedline 4 is connected to the third sheet-metal angle 9 via the coaxial feedthrough 5. The two first sheet-metal angles 2, 3 are parasitically coupled.

Figure 6:
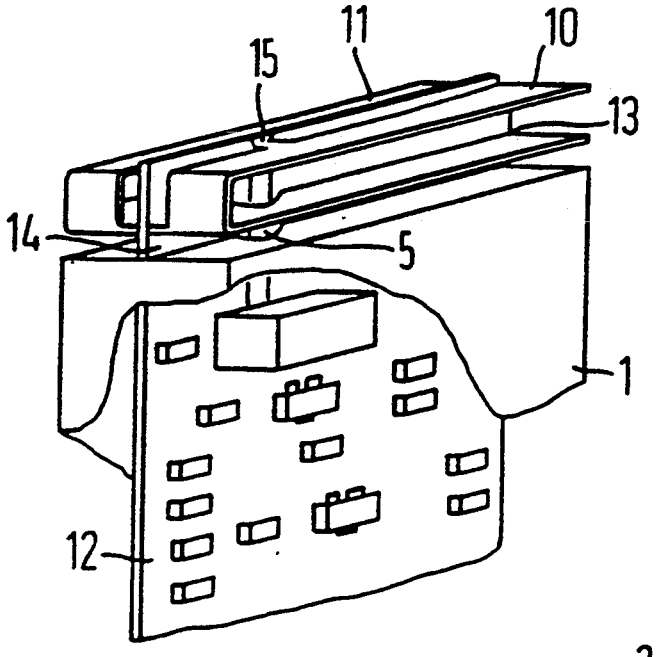
FIG. 6 shows an example of the integration on a board.

In the example according to FIG. 6, the shielding housing 1 consists of two parts and encloses a board 12 on which the components of the appliance are arranged. The board 12 protrudes between the parts of the shielding housing 1 on the upper narrow side and is provided with an ground area 14. The antenna consists of sheet-metal angles 10, 11 which have a U-shaped longitudinal section. They are connected to the ground area 14 over the entire length of the respective lower leg of the sheet-metal angles 10, 11 by means of a solder joint 13, and attached to the board 12. They are fed via a conductor track through the feedthrough 5 in the shielding housing 1 and a recess in the lower leg of the sheet-metal angle 10 to the feedpoint 15. Here, too, the sheet-metal angle 10 is connected to the board 12. If required, the free resonator end can also be connected to the board 12. Both separate and common feeding of the sheet-metal angles 10, 11 is possible.

Figure 7:
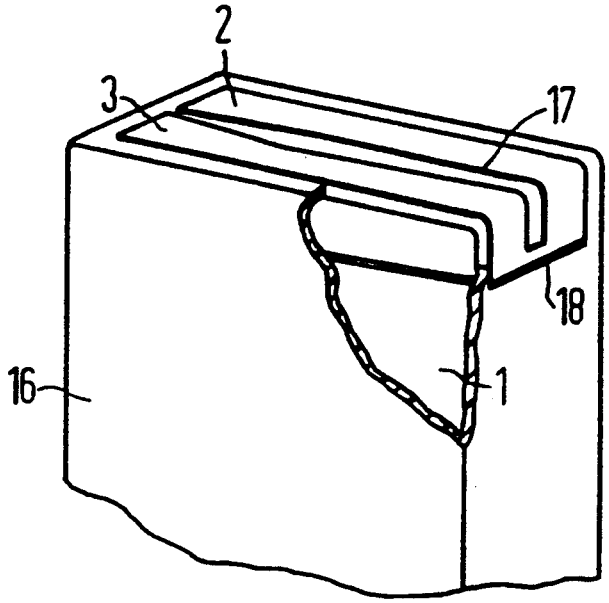
FIG. 7 shows an example with resonators of metal foil.

In another example according to FIG. 7, the shielding housing 1 is surrounded by a plastic housing 16. The sheet-metal angles 2, 3 are molded onto the plastic housing 16 on the outside. It would also be possible to etch them out. From a feedpoint 17, the sheet-metal angle 2 is connected to the transmitter/receiver. Contact between the sheet-metal angles 2, 3 and the shielding housing 1 is established by a ground feedthrough 18.

Figure 8:
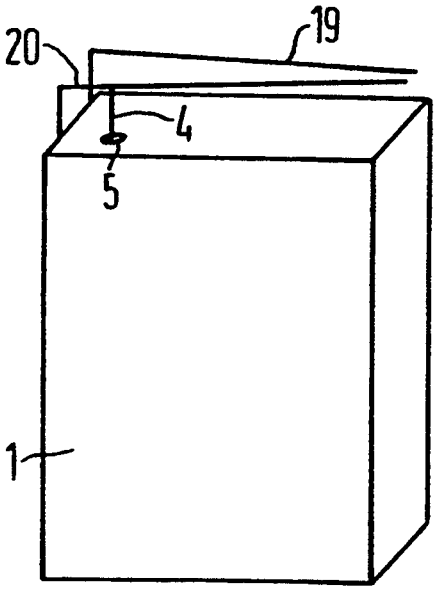
FIG. 8 shows an example with resonators of wire angles.

The antenna of the transmitting and receiving arrangement according to FIG. 8 is made of wire angles 19, 20. They extend towards each other and are only barely separated from one another at the free resonator end. The wire angles 19, 20 are soldered to the shielding housing 1 and the second wire angle 20 is connected to the transmitter/receiver via a feedline 4. For this purpose, the shielding housing 1 has a coaxial feedthrough 5. These wire angles 19, 20 are constructed to be stretched and have therefore a simple shape. The shielding housing 1 does not have a step.

The invention is not limited to the particular details of the apparatus and method depicted and other modifications and applications are contemplated. Certain other changes may be made in the above described apparatus and method without departing from the true spirit and scope of the invention herein involved. It is intended, therefore, that the subject matter in the above depiction shall be interpreted as illustrative and not in a limiting sense.

What is claimed is:

1. A transmitting and/or receiving arrangement for portable appliances, comprising: a shielding housing of metal, containing a radio-frequency section, and an antenna, the antenna having at least two antenna resonators which are parasitically coupled to one another and are essentially identically oriented in a longitudinal direction, each of the at least two antenna resonators having one free resonator end and one end angled via a bending edge and conductively connected to the shielding housing, a transmitter output and a receiver input, respectively, being connected only to a feedpoint of a single antenna resonator of the at least two antenna resonators via a feedline through a coaxial feedthrough in the shielding housing, which feedpoint is located between the bending edge and the free resonator end of the single antenna resonator, and an inside clearance of a slot formed between two adjacent antenna resonators of the at least two antenna resonators being much less in an area of the free resonator end than at the bending edge for varying the input impedance of the antenna.

2. A transmitting and receiving arrangement for portable appliances, comprising: a shielding housing of metal, containing a radio-frequency section and an antenna, the antenna having at least two antenna resonators which are parasitically coupled to one another and are essentially identically oriented in a longitudinal direction, each of the at least two antenna resonators having one free resonator end and one end angled via a bending edge and conductively connected to the shielding housing, a transmitter output and a receiver input each being connected through a respective coaxial feedthrough in the shielding housing to a respective feedpoint of a respective antenna resonator of the at least two antenna resonators via a respective feedline, each feedpoint being located between the bending edge and the free resonator end of the respective antenna resonator, and an inside clearance of a slot formed between two adjacent antenna resonators of the at last two antenna resonators being much less in an area of the free resonator end than at the bending edge for varying the input impedance of the antenna.

3. The arrangement as claimed in claim 1, wherein the antenna resonators are arranged on a cover area of the shielding housing.

4. The arrangement as claimed in claim 1, wherein the antenna has at least two fed part-antennas which are opposite one another and wherein each of the at least two fed part-antennas has at least two antenna resonators which are parasitically coupled to one another and are essentially identically oriented.

5. The arrangement as claimed in claim 1, wherein the antenna resonators have unequal lengths.

6. The arrangement as claimed in claim 1, wherein the antenna resonators are formed from sheet-metal angled sections.

7. The arrangement as claimed in claim 6, wherein the antenna has three sheet-metal angled sections and wherein a center sheet-metal angled section of the three angled sections is connected to the feedline.

8. The arrangement as claimed in claim 6, wherein the shielding housing and the sheet-metal angled sections are stamped out of a flat metal sheet and are bent into a predetermined shape.

9. The arrangement as claimed in claim 6, wherein the sheet-metal angled sections are soldered to the shielding housing.

10. The arrangement as claimed in claim 6, wherein each of the sheet-metal angled sections have a U-shaped longitudinal section and a leg thereof, which is not fed and which is not parasitically coupled, is conductively attached to a board protruding from the shielding housing and is connected to the shielding housing via a ground area.

11. The arrangement as claimed in claim 10, wherein the board protrudes between the free resonator ends of the sheet-metal angled sections and wherein the free resonator ends are connected to the board.

12. The arrangement as claimed in claim 6, wherein the shielding housing is surrounded by a plastic housing onto which the sheet-metal angled sections are applied as metal foil on one of the outside and inside and are connected to the shielding housing via a ground feed-through.

13. The arrangement as claimed in claim 1, wherein the antenna resonators are formed from angled wires.

14. The arrangement as claimed in claim 2, wherein the antenna resonators are arranged on a cover area of the shielding housing.

15. The arrangement as claimed in claim 2, wherein the antenna has at least two fed part-antennas which are opposite one another and wherein each of the at least two fed part-antennas has at least two antenna resonators which are parasitically coupled to one another and are essentially identically oriented.

16. The arrangement as claimed in claim 2, wherein the antenna resonators have unequal lengths.

17. The arrangement as claimed in claim 2, wherein the antenna resonators are formed from sheet-metal angled sections.

18. The arrangement as claimed in claim 17, wherein the antenna has three sheet-metal angled sections and wherein a center sheet-metal angled section of the three angled sections is connected to the feedline.

19. The arrangement as claimed in claim 17, wherein the shielding housing and the sheet-metal angled sections are stamped out of a flat metal sheet and are bent into a predetermined shape.

20. The arrangement as claimed in claim 17, wherein the sheet-metal angled sections are soldered to the shielding housing.

21. The arrangement as claimed in claim 17, wherein each of the sheet-metal angled sections have a U-shaped longitudinal section and a leg thereof, which is not fed and which is not parasitically coupled, is conductively attached to a board protruding from the shielding housing and is connected to the shielding housing via a ground area.

22. The arrangement as claimed in claim 21, wherein the board protrudes between the free resonator ends of the sheet-metal angled sections and wherein the free resonator ends are connected to the board.

23. The arrangement as claimed in claims 17, wherein the shielding housing is surrounded by a plastic housing onto which the sheet-metal angled sections are applied as metal foil on one of the outside and inside and are connected to the shielding housing via a ground feed-through.

24. The arrangement as claimed in claim 2, wherein the antenna resonators are formed from angled wires.

* * * * *